United States Patent [19]

Papajewski et al.

[11] 4,422,397

[45] Dec. 27, 1983

[54] NEEDLE THREAD WIPING DEVICE

[75] Inventors: Reinhold Papajewski, Stutensee-Friedrichsthal; Lothar Reinfurth, Karlsruhe, both of Fed. Rep. of Germany

[73] Assignee: The Singer Company, Stamford, Conn.

[21] Appl. No.: 299,243

[22] Filed: Sep. 3, 1981

[51] Int. Cl.[3] ..... D05B 65/06

[52] U.S. Cl. ..... 112/286

[58] Field of Search ..... 112/245, 286, 293, 301

[56] References Cited

U.S. PATENT DOCUMENTS

| | | | |
|---|---|---|---|
| 3,901,171 | 8/1975 | Rosa | 112/286 |
| 3,960,098 | 6/1976 | Papajewski et al. | 112/286 |
| 4,187,792 | 2/1980 | Boser et al. | 112/286 |

FOREIGN PATENT DOCUMENTS

| | | | |
|---|---|---|---|
| 6940755 | 10/1969 | Fed. Rep. of Germany . | |
| 2259059 | 6/1973 | Fed. Rep. of Germany | 112/286 |
| 50-59151 | 5/1975 | Japan . | |
| 50-143745 | 11/1975 | Japan . | |
| 52-13945 | 1/1977 | Japan . | |
| 52-21930 | 6/1977 | Japan | 112/286 |
| 53-26662 | 3/1978 | Japan . | |
| 53-73153 | 6/1978 | Japan . | |

*Primary Examiner*—Wm. Carter Reynolds
*Attorney, Agent, or Firm*—Edward P. Schmidt; Robert E. Smith; Edward L. Bell

[57] ABSTRACT

A needle thread wiping device having a mounting bracket supported beneath the head behind the needle bar. The mounting bracket supports a pair of shafts which extend laterally therefrom towards both sides of the head. A thread wiper assembly may be fastened to one side or to both sides of the mounting bracket by means of a lever which may be affixed to a forwardly located shaft by a set screw. One end of the lever carries a sleeve. A link is carried on the second shaft, the link also carrying a sleeve, both sleeves slidably supporting therein a thread wiper having a hooked end. A back plate is provided having a curved slot supported on the second shaft and having a pivotal connection to the sleeve in the end of the lever. The thread wiper also has a connection to the back plate. If the lever is made to rotate, the thread wiper moves with its motion, as does the back plate which causes the hooked end of the thread guide to travel a path from outside of the stitching area to a position across the path of the sewing needles and the return to initial position for carrying a cut thread out of a work material.

1 Claim, 7 Drawing Figures

NEEDLE THREAD WIPING DEVICE

DESCRIPTION

BACKGROUND OF THE INVENTION

This invention is in the field of sewing machines; more particularly, it is concerned with a needle thread wiping device suitable for use in a wide variety of sewing machines.

There are many examples in the prior art of thread wiping devices used to avoid the necessity of having an operator remove the severed thread end from a work piece. Such a device is shown in U.S. Pat. No. 3,901,171, issued on Aug. 26, 1975 to Rosa.

Many of these prior art devices have limitations of one sort or another. For example, the devices may be bulky, may only operate with a single needle, or, in some cases, may interfere with an operator's free motions in the stitching area. As examples of prior art devices, there are the Japanese Lay-Open Nos. 53-2662 and 52-13945 of Brother Industries, laid-open on Mar. 7, 1978 and Jan. 31, 1977, respectively. These Japanese Lay-Opens disclose thread wiping devices for double needle sewing machines which are cumbersome, bulky, and in some cases, may interfere with the operation of the sewing machine.

What is required is a thread wiping device which is compact, may be stored entirely out of the sewing area for the least interference with an operator of a sewing machine, may be readily retrofitted on a wide variety of sewing machines, and for selective use for single or double needle sewing machines. Ideally, such a device should be capable of economic manufacture.

SUMMARY OF THE INVENTION

The above requirements are attained in a sewing machine in which a mounting bracket is supported beneath the head end of the sewing machine behind the presser bar thereof. The mounting bracket supports a driving shaft and a guiding shaft extending laterally therefrom on both sides thereof and spaced from each other in the front to back direction. A thread wiper element is provided having a lever affixed to the forward shaft, with a first collar pivotably carried at one end of the lever. The other end of the lever is aranged to be actuated by either an air cylinder or a connecting rod urged into the path of the needle bar to be carried thereby in an upward direction. A link is provided carried on one end by the other of the shafts, the link having a second collar pivotably carried in the other end of the link. A thread wiper is provided having a hook on one end thereof, and extending from a rod portion thereof which is slidably carried by the first and second collar. A back plate is provided having slots therein which are engaged by the second shaft and a shoulder screw extending into the first collar for the purpose of moving the hook end of the thread wiper from a position outside of the endwise path of reciprocation of a sewing needle and needle bar to a position adjacent the path thereof close by the sewing machine throat plate. A follower is adjustably attached to the rod of the thread wiper to extend into a socket in the back plate so as to rotate the rod on motion thereof relative to the back plate, in order to provide a transverse motion of the hook end of the thread wiper across the path of reciprocation of the needle for return thereacross to remove a cut thread from the work material.

BRIEF DESCRIPTION OF THE DRAWINGS

In order that the invention may be more fully understood, it will now be described, by way of example, with reference to the accompanying drawings in which:

Referring now to FIG. 1 there is shown the head end 10 of an industrial sewing machine to which the subject needle thread wiping device has been applied. Thus, in FIG. 1, there is shown a horizontal arm shaft 12 which drives the usual thread take-up lever 14 and connecting link 16 providing connection to a driving stud 18 carried by the sewing machine needle bar 20 for endwise reciprocation thereof. In the embodiment shown in FIG. 1, a needle bar 20 supports in the end thereof, needles 22 arranged in narrow gauge. Situated behind the needle bar 20 is a presser bar 24 to which is affixed a presser foot 26 by screw 27. Attached to the presser foot 26 is a needle guard 28 designed to prevent the insertion of an operator's finger beneath the sewing needles 22. Thus, the needle guard 28 sits about the sewing needles 22 in operation and provides a safety function, however, increasing the difficulty in providing for a device to wipe the severed sewing threads out of the work material. The driving stud 18 connected to the needle bar 20 is fashioned with an extended pin 30, which extended pin terminates in a stub axle 31 the purpose of which will be explained below. The extended pin 30 is encircled by one end of the connecting link 16 for driving arrangement of the needle bar 20 through the driving stud 18, and also carries thereon a collar 32 constrained to slide within a slotted guide 34 to stabilize the motion of the needle bar against rotation thereof which would interfere with the stitching process. The slotted guide 34 is fastened to the frame of the sewing machine by screws 35, and may be provided with wicking 36 to lubricate the reciprocation of the collar 32 in the guide.

Figure 1:
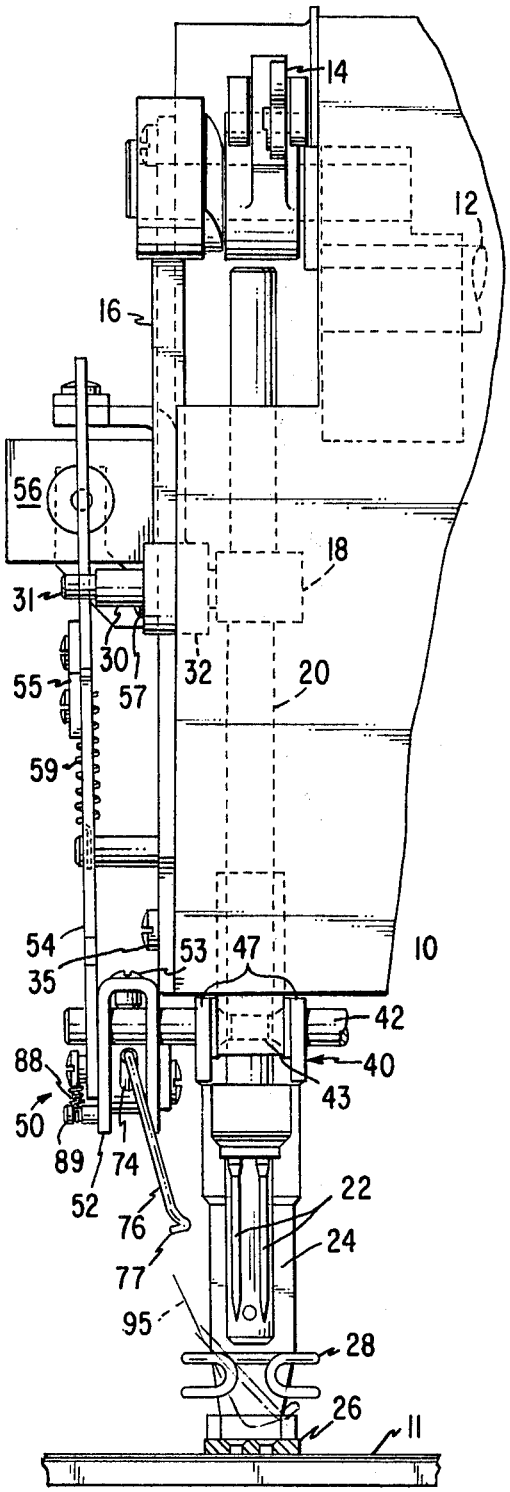
FIG. 1 is a front elevation of a head end of a sewing machine in which the invention has been applied showing the actuating means therefor and in the non-actuated position.
Figure 2:
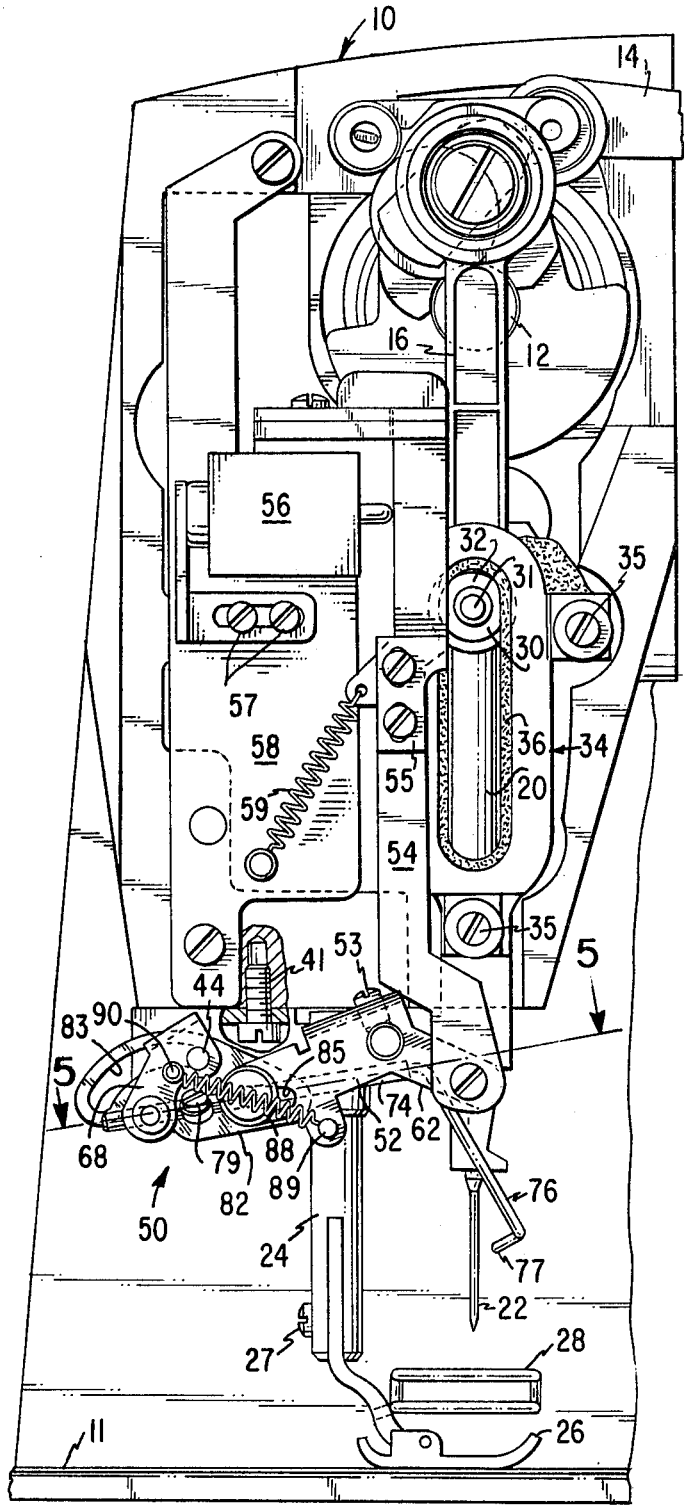
FIG. 2 is a head end elevation of the sewing machine shown in FIG. 1 showing the thread wiping device thereof and the actuating device therefore in greater detail in the at rest position.
Figure 3:
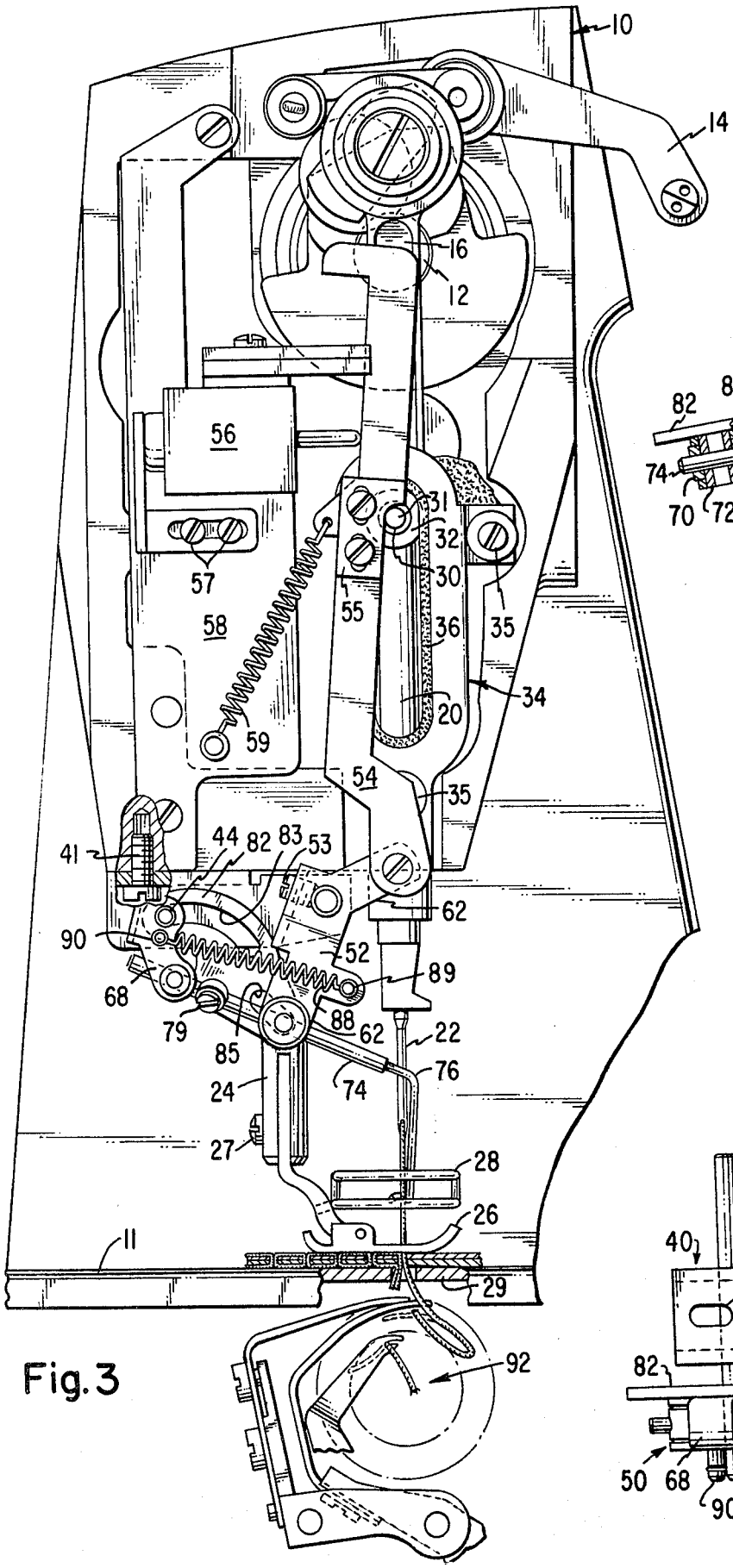
FIG. 3 is a head end elevation corresponding to FIG. 2 showing the thread wiping device actuated to a position preparatory to initiate a wiping function with the thread wiper in its most extended position.

Visible in FIGS. 1 through 4 and 6, is a mounting bracket 40 which is fastened to the bottom of the head end 10 by two screws 41, one of which is visible in FIG. 2, and the other shown in FIG. 3. The mounting bracket 40 is implemented by a channel having two slots 46 in the top thereof to accommodate screws 41 for adjustable positioning thereof. The forward end of the mounting bracket 40 has the top removed to permit passage of the presser bar 24 therethrough (see FIG. 4). The mounting bracket 40 supports therein a forward shaft 42 having a reduced cross section 43 in the center thereof to accommodate passage of the presser bar 24. A second shaft 44 is situated behind the first shaft 42 and parallel thereto. The first shaft 42 and second shaft 44 are retained in place by tension washers 45 situated on the inner side of the flanges 47 of the mounting bracket 40, the shafts extending beyond both sides of the bracket. Thus has been disclosed one means for supporting a mounting bracket 40 beneath the head end 10 of a sewing machine. It is evident that other means may be provided to accomplish the same end, for example, the mounting bracket might be part of a larger bracket which is attached to the rear or to the side of the head end 10. In other words, a system could be devised for supporting a mounting bracket 40 beneath the head end which would be compatable with almost any configuration.

Figure 4:
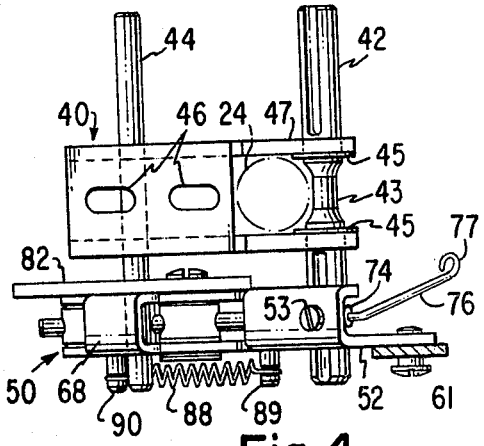
FIG. 4 is a plan view of the thread wiper device and the mounting bracket.
Figure 6:
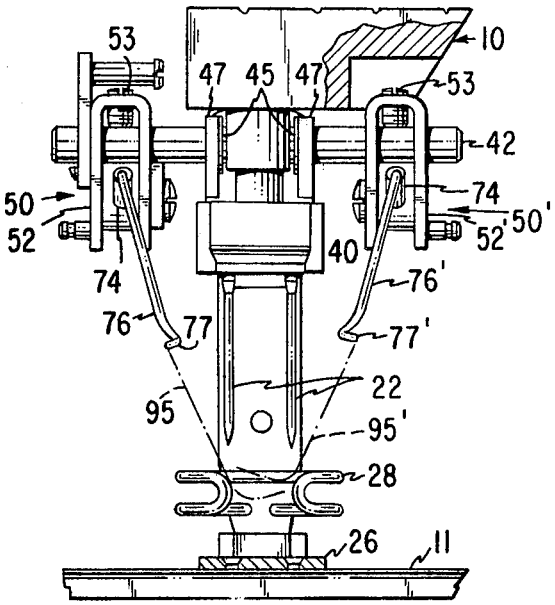
FIG. 6 is a view similar to FIG. 1 showing the thread wiper device as applied to a two needle sewing machine with wider needle gauge.

A thread wiper mechanism 50 comprises the complete assembly supported on the shafts 42, 44 of the mounting bracket (see FIGS. 1 and 4 and 6). In FIGS. 1 through 4, an arrangement is disclosed in which a thread wiper mechanism 50 is supported on only one side of the mounting bracket 40. In FIG. 6 an arrangement is disclosed having thread wiper mechanisms 50, 50' on both sides of the mounting bracket, with only slight differences therebetween which will be disclosed below. Referring to FIGS. 1 through 4, the thread wiper mechanism includes a lever 52 which is connected to the first shaft 42 by screw 53. The lever 52 has one end thereof connected to a connecting link 54 for rotation of the lever and the first shaft 42 in the mounting bracket 40. The operation of the connecting link 54 in causing rotation of the driving arm 52 and first shaft 42 in the mounting bracket 40 may be more fully understood by reference to the U.S. Pat. No. 3,960,098 issued on June 1, 1976 to Papajewski et al., and assigned to the same assignee as the instant application, which patent is hereby incorporated by reference herein. The operation of the connecting link 54, however, may be described briefly by reference to FIGS. 2 and 3 of the drawings in which there is disclosed a solenoid 56, adjustably carried by a bracket 58 and maintained in an adjusted position by screws 57, which solenoid acts upon the connecting link 54 at the proper time in the sewing cycle to deflect the connecting link into the path of the stub axle 31 on the end of the driving stud 18 (see FIG. 3). The upward motion of the driving stud 18 causes the stub axle 31 to elevate the connecting link 54, thereby rotating the lever 52 and first shaft 42 in the mounting bracket 40. An adjustment plate 55 is carried by the connecting link in order to provide some degree of adjustability of the rotation of the lever 52 for a purpose which will explained below. In operation, the sewing machine will be stopped with the needle bar 20 in an elevated position as shown in FIG. 3. Thereafter, when the solenoid 56 is deenergized, the connecting link 54 will be freed from engagement with the stub axle 31 for return to its original position by a coil spring 59 extending between the connecting link and a post on the bracket 58. This action will cause the lever 52 to return to the position shown in FIG. 2, that is, to its original position. It will be apparent to those skilled in the art that one means has been shown for rotating the lever 52 and first shaft 42 in the mounting bracket 40. Other means will immediately suggest themselves to those skilled in the art; for example, an air cylinder may be utilized to actuate the lever 52 or actuation thereof may be affected by a knee shifter or foot treadle, electric motor, solenoid, etc.

Figure 5:
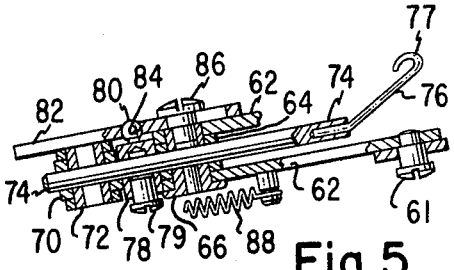
FIG. 5 is a sectional view taken along line 5—5 of FIG. 2 of the thread wiper device.

By inspection of FIGS. 1, 4 and 5, it will be seen that the lever 52 is of U-shaped cross section, with one leg of the U extended for connection to the connecting link 54 by means of a shoulder screw 61 which allows the connecting link to freely pivot with respect to the lever. The lever 52 is fashioned with two rearwardly extending legs 62 (see FIG. 5), there being a sleeve 64 inserted between the legs, and a headed stud 66 having its head on the external portion of one leg and extending through the sleeve and the other arm 62 to terminate at the surface thereof. The sleeve 64 is fashioned with a hollow bore to accommodate the headed stud 66, and both the sleeve and headed stud are fashioned with a transverse bore for a purpose which will be explained below.

The second shaft 44 extends through the closed end of a U-shaped link 68, the open end of which supports therebetween a sleeve 70 retained therein by a stud 72 extending through openings provided therefore in the link (see FIG. 5). The sleeve 70 and stud 72 are fashioned with a transverse bore similar to that through the sleeve 64 and headed stud 66 attached to the lever 52. A rod 74 is slidably accommodated in these transverse bores, the rod extending beyond both sleeves 64, 70. The rod 74 supports in a bore in the end thereof a thread wiper 76 implemented by a specifically shaped rigid wire form which may be attached to the rod in any suitable fashion as by soft solder or brazing. The thread wiper 76 is fashioned with a hook 77 on the end thereof. The rod 74 supports thereon between the sleeve 64 and sleeve 70 a follower bracket 78 having a lug or ball 80 extending therefrom. The position of the follower bracket 78 on the rod may be adjusted both along the length of the rod as well as angularly thereabout by means of a screw 79 which serves to clamp an adjusted position of the ball 80 with respect to the rod 74 and thread wiper 76. A back plate 82 is provided, the back plate having a curved slot 83 supported on the second shaft 44 and a cavity 84 for accommodating the ball 80. A shouldered screw 86 extends through a slot 85 in the back plate 82 and is threadedly carried in the end of the headed stud 66 carried by lever 52, so as to permit free motion of the screw in the slot 85. Lastly, a spring 88 is provided extending between a pin 89 supported by the lever 52, and a stud 90 carried by the U-shaped link 68. The spring 88 serves at all times to draw the U-shaped link 68 towards the lever 52 as will be explained below.

Supported beneath the bed 11 of the sewing machine there is indicated a thread cutter 92 whose purpose, as is well known in the sewing machine art, is to sever the threads extending from the work material to the thread supplies of the sewing machine. Any of a wide variety of thread trimmers may be employed such as the one disclosed in the U.S. Pat. No. 4,235,179, issued on Nov. 25, 1980 which is hereby incorporated herein by reference. Normally, in an industrial sewing machine at the termination of stitching, the operator would manipulate the treadle in a fashion to signal the sewing machine to effect the last tack, raise the needle bar, trim and wipe the threads and elevate the presser foot. In operation, the sewing machine appears as is shown in FIGS. 1 and 2, with the connecting link 54 retained in an inoperative position by the spring 59. After completion of the last tack and prior to raising the needle bar 20 to an elevated position, the solenoid 56 is activated and the connecting link 54 is deflected thereby into the position shown in FIG. 3 so that the stub axle 31 acting on the adjustment plate 55 will raise the connecting link to an elevated position. The elevation of the connecting link 54 rotates the lever 52 counterclockwise as shown in FIG. 3. Rotation of the lever 52 carries the shouldered screw 86 connected thereto down the slot 85 in the back plate 82, causing the back plate to rotate clockwise along curved slot 83 to the position shown in FIG. 3 carrying the ball 80 therewith, and causing the rod 74 to rotate and translate through transverse bore in sleeve 64 and in sleeve 70 to the position shown in FIG. 3 so that the hook 77 on the end of the thread wiper 76 follows the path 95 indicated in FIG. 1 to a point below the sewing needles 22 and inside of the needle guard 28. The location of the ball 80 in the cavity 84 in the back plate 82 and the shifting of the rod 74 from the position shown in FIG. 2 to that shown in FIG. 3 with the shouldered screw 86 at the end of the slot 85 forming a new alignment between the transverse bore and the sleeve 70, follower bracket 78 and sleeve 64, will create a rotation of the rod 74 having the effect of moving the hook 77 transversely of and beneath the sewing needles 22 at the end of its travel, so that the hook takes the final position indicated in phantom in FIG. 1. Three dimensional motion of the hook 77 is brought about by the endwise rotation and translation of the rod 74 substantially in a first plane from the position shown in FIG. 2 to that shown in FIG. 3, and by the axial rotation of the rod rotating the hook in a second plane normal to this first plane due to the new alignment. The timing is such that immediately thereafter the thread cutter 92 may sever the sewing threads. The solenoid 56 may thereupon be deactivated allowing the connecting link 54 to be drawn back to the position shown in FIG. 2 by the coil spring 59. This action of the coil spring 59 causes the lever 52 to be rotated clockwise, thereby causing the thread wiper 76 to retrace the path 95 back to the starting position shown in FIGS. 1 and 2 so as to move the severed needle thread end to a preferred position out of the work material.

Figure 7:
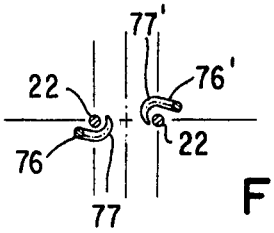
FIG. 7 is a plan view of the hooks of the thread wiper of the thread wiper device shown in FIG. 6, in the actuated position to indicate the difference in configuration thereof.

In FIG. 6 there is shown a sewing machine with wider gauge sewing needles 22 and with the presser bar 24 and presser foot 26, the presser foot having a needle guard 28 attached thereto. A thread wiper mechanism 50 is shown in the left side and a thread wiper mechanism 50' is shown on the right side in which many parts are identical except for the levers 52 and 52' which are mirror images of each other. Similarly, the hooks 77, 77' of the thread wipers 76, 76' are arranged in somewhat different relationship so as not to interfere with each other (see FIG. 7). In FIG. 6, the paths 95, 95' of the hooks 77, 77' is shown. The drive arrangement for the first shaft 42 are not shown but may, as indicated previously, be implemented by a connecting link 54, by an air cylinder or by any other means which would be well known to a sewing machine mechanic. Rotation of one lever 52 by whatever drive means is provided will, through the first shaft 42, cause rotation of the other lever 52' for simultaneous actuation of the thread wipers.

Thus has been described a thread wiping device useful for a single or double needle machine which passes from a position outside of the stitching area to a location below the sewing needles 22 and inside of a needle guard 28. The thread wiper 76 executes a lateral movement beneath and about the sewing needle 22 so as to pick up a needle thread on a return movement to its rest position. The thread wiping device is carried by a mounting bracket supported beneath the head end of the sewing machine by any suitable means including screws directly attaching the mounting bracket to the head end, or by means of an additional bracket fastened to the head end so as to support the mounting bracket in this position. The mounting bracket supports a first shaft 42 and a second shaft 44, which shafts in turn support and actuate thread wiper mechanism 50. The first shaft 42 and second shaft 44 are arranged on both sides of the mounting bracket 40 so as to be able to support and actuate a wiper mechanism 50 and 50' for use in a two needle machine of wider gauge. The thread wiper mechanisms 50, 50' are supported on the shafts 42, 44 in a position fixed by screws 53, 53' so that the thread wipers 76, 76' are properly located relative to the sewing needles 22. The path of the hooks 77, 77' of the thread wipers 76, 76' may be adjusted for proper lateral motion with respect to the sewing needles 22 by an adjustment utilizing the screw 79 (see FIG. 5) to obtain the proper transverse motion with respect to the sewing needles. The curved slot 83 and slot 85 of the back plate 82 may also be altered to vary movement of the thread wipers 76, 76' so that special conditions and requirements in the area of the needle guard 28 and sewing needles 22 might be accommodated. Lastly, the thread wiper mechanisms 50, 50' used for left or right position are substantially identical except for the levers 52, 52' and the thread wipers 76, 76'.

We claim:

1. A needle thread wiping device adapted for use on a sewing machine having a frame, said frame including a work supporting bed having at least one orifice therein, at least one thread carrying needle supported by said frame for reciprocation in an endwise path through said at least one orifice, and a thread trimming mechanism associated with said sewing machine for severing sewing thread, said thread wiping device comprising in combination:

a. a mounting bracket;

b. means for supporting said mounting bracket on said sewing machine frame adjacent said endwise path of reciprocation of said thread carrying needle;

c. a first and second substantially parallel shafts supported in said mounting bracket;

d. a lever carried by said first shaft, a first sleeve pivotably carried by one end of said lever;

e. means for selectively actuating said lever to rotate the same relative to said mounting bracket when said thread carrying needle is reciprocated upwardly;

f. a link having one end carried by said second shaft, a second sleeve pivotably carried in the other end of said link;

g. a thread wiper having a hook on one end thereof;

h. means for slidably supporting said thread wiper in said first and second sleeves;

i. means for constraining three dimensional motion of said thread wiper on actuation of said actuating means, said constraining means further comprising a back plate having a curved slot with said second shaft extending therethrough and a pivotal connection between said back plate and said first sleeve, whereby said hook end of said thread wiper is influenced upon actuation of said actuating means to move substantially in a first plane at a shallow angle to said needle from an initial position outside of said endwise path of reciprocation of said thread carrying needle to a position substantially in said path immediately adjacent said orifice and later return to said initial position from said position substantially in said path upon deactuation of said actuating means, and a lug carried by said thread wiper having a portion thereof pivotally connected to said back plate whereby said hook end of said thead wiper is influenced by the latter part of said actuation of said actuating means to implement a motion in said hook end in a second plane substantially normal to said first plane from substantially in said path immediately adjacent said orifice transversely across said path of said at least one needle, and an immediate return therefrom upon deactuation of said actuating means.

* * * * *